US005996160A

United States Patent [19]

Pruitt

[11] Patent Number: 5,996,160

[45] Date of Patent: Dec. 7, 1999

[54] ENTRY DOOR MAT

[76] Inventor: David D. Pruitt, 30041 Tessier, Apt. 129, Laguna Niguel, Calif. 92677

[21] Appl. No.: 08/906,189

[22] Filed: Aug. 4, 1997

[51] Int. Cl.[6] ..... A47L 23/26

[52] U.S. Cl. ..... 15/104.92; 15/216; 15/217

[58] Field of Search ..... 15/215, 216, 217, 15/104.92, 237, 238

[56] References Cited

U.S. PATENT DOCUMENTS

| | | | |
|---|---|---|---|
| 260,311 | 6/1882 | O'Blenus . | |
| 685,916 | 11/1901 | Gawne et al. . | |
| 1,544,914 | 7/1925 | Larsen | 15/215 |
| 2,704,852 | 3/1955 | Stone . | |
| 3,765,047 | 10/1973 | Tashjian | 15/104.92 |
| 4,425,677 | 1/1984 | Cox . | |
| 4,849,271 | 7/1989 | Weihrauch . | |
| 4,866,805 | 9/1989 | Oden et al. . | |
| 5,071,628 | 12/1991 | Alazet . | |
| 5,297,309 | 3/1994 | Rotoli . | |
| 5,556,685 | 9/1996 | Swicegood, Jr. . | |

FOREIGN PATENT DOCUMENTS

| | | | |
|---|---|---|---|
| 711153 | 6/1954 | United Kingdom | 15/217 |

*Primary Examiner*—Randall E. Chin

*Attorney, Agent, or Firm*—Stetina Brunda Garred & Brucker

[57] ABSTRACT

An entry mat for placement before an entry door to permit cleaning of shoe soles. The entry mat has a liquid reservoir with an open top, and a plurality of adjacent parallel generally cylindrical brushes mounted such that certain bristles thereof extend outwardly from the open top of the liquid reservoir for engagement of a shoe bottom and certain bristles thereof extend inwardly into the reservoir. At least one of the cylindrical brushes is rotatable. The mat has a liquid absorbing fabric material releasably retained in a taut configuration by a stretcher, a wiping mat, and a frame member having respective compartments within which the liquid reservoir, liquid absorbing fabric material and wiping mat are housed. Use of the entry mat is a three step process wherein shoe soles are first wiped on the wiping mat to remove larger sized debris. Next, the shoe soles are subjected to the brushes whereby the at least one rotating brush introduces liquid from the reservoir to the soles for cleansing. Finally, the shoe soles are repeatedly rubbed on the taut liquid absorbing fabric material for drying.

12 Claims, 2 Drawing Sheets

Fig. 1
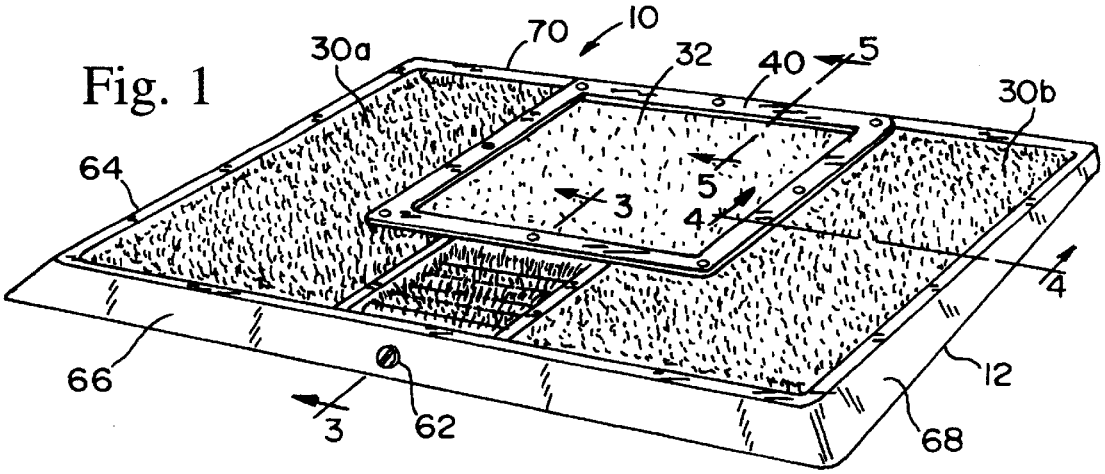
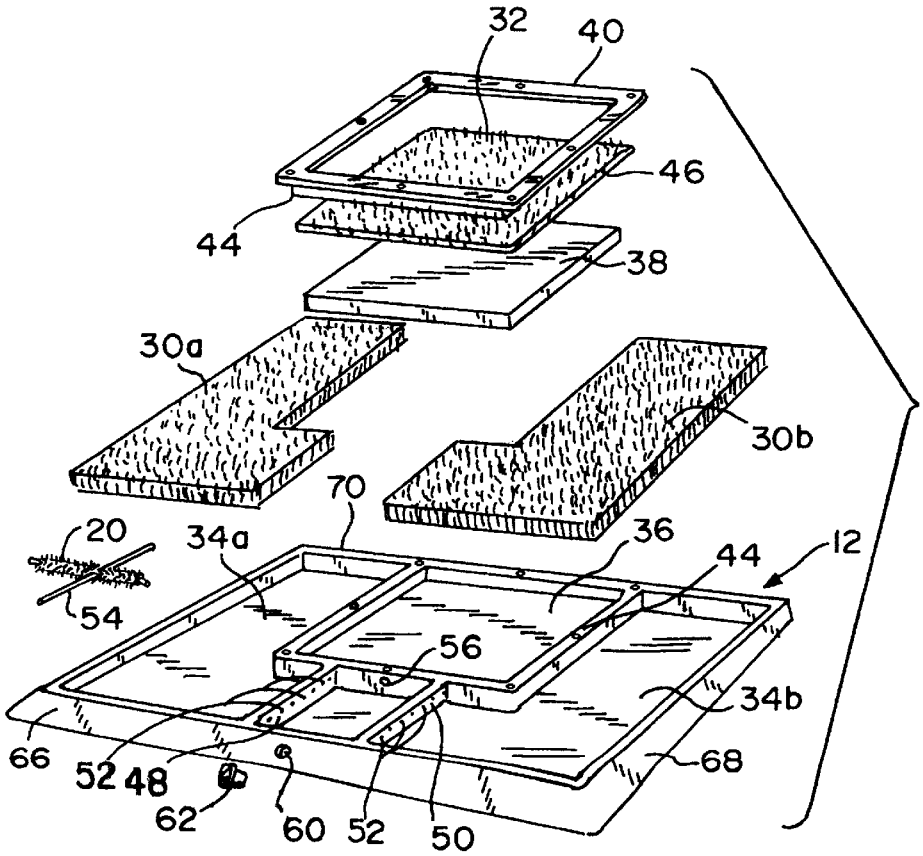
Fig. 2

ENTRY DOOR MAT

FIELD OF THE INVENTION

This invention relates in general to entry door mats, and in particular to an entry door mat having a frame member within which are situated a wiping mat, a liquid reservoir with brushes for cleansing shoe soles, and a liquid absorbing fabric material for drying the soles.

BACKGROUND OF THE INVENTION

While entry door mats are commonly found at front doors, back doors, inside garage entry doors, and the like of homes and businesses, such mats generally are of a single-component material and often constructed of an abrasive fiber. Persons entering the doors tend to wipe their shoe soles on the mats to thereby attempt to remove all sorts of grime from the shoes. Such untoward material can include mud, dirt, gum, oil, road tar, and various other precipitates that can stay with a shoe sole. As is apparent from the wide scope of debris that thus may be present, some of these materials are not easily removed by simple wiping on a conventional door mat. Additionally, those materials that are removed remain in the mat, and can be picked up by subsequent users and carried inside the door anyway.

In view of the above difficulties and the general inefficiencies of conventional entry door mats, it is apparent that a need is present for an entry mat that can provide significant cleaning of shoe soles before the wearer enters a home, business, or other area to be protected from shoe-borne soil. Accordingly, a primary object of the present invention is to provide an entry mat that provides for liquid washing of a shoe sole followed by drying with a liquid absorbing fabric material.

Another object of the present invention is to provide an entry mat wherein liquid washing is enhanced by brushes that apply the cleansing liquid.

Yet another object of the present invention is to provide an entry mat for a three step process of sole cleaning comprising a wiping mat for initial contact, brushes for liquid cleaning, and a tautly retained liquid absorbing material for drying the sole.

These and other objects of the present invention will become apparent throughout the description thereof which now follows.

SUMMARY OF THE INVENTION

The present invention is an entry mat for placement before an entry door to permit cleaning of shoe soles prior to entry of the shoe wearer through the door. The entry mat comprises a liquid reservoir with an open top, and a plurality of adjacent parallel generally cylindrical brushes mounted such that certain bristles thereof extend outwardly from the open top of the liquid reservoir for engagement of a shoe bottom and certain bristles thereof extend inwardly into the reservoir. At least one of the cylindrical brushes is rotatable with appropriate foot action thereto by a user. The mat further comprises a liquid absorbing fabric material releasably retained in a taut configuration by a stretcher, a wiping mat, and a frame member having respective compartments within which the liquid reservoir, liquid absorbing fabric material and wiping mat are housed. Contemplated use of the entry mat foresees a three step process wherein shoe soles are first wiped on the wiping mat to remove larger sized debris. Next, the shoe soles are subjected to the brushes whereby the at least one rotating brush introduces liquid from the reservoir to the soles for cleansing. Finally, the shoe soles are repeatedly rubbed on the taut liquid absorbing fabric material for drying. Assuming the mat is immediately in front of the door to be entered, a person then directly passes through the door and presents clean shoe soles to the entered area.

BRIEF DESCRIPTION OF THE DRAWINGS

An illustrative and presently preferred embodiment of the invention is shown in the accompanying drawings in which:

FIG. 1 is a perspective view of an entry door mat;

FIG. 2 is an exploded perspective view of the door mat of FIG. 1;

DETAILED DESCRIPTION OF THE PREFERRED EMBODIMENT

Figure 3:
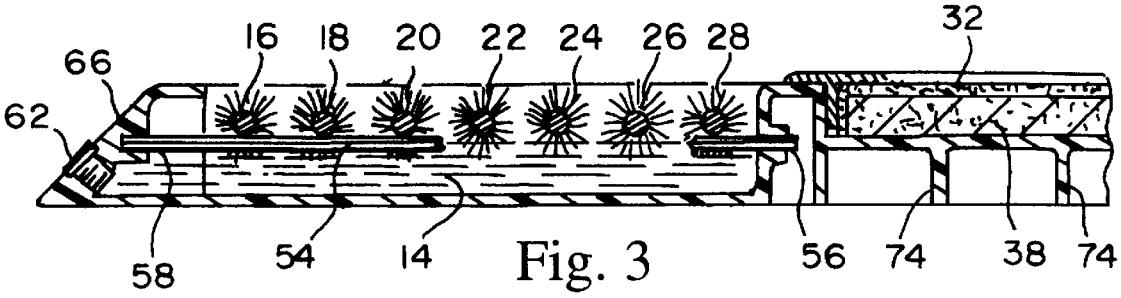
FIG. 3 is, a cross section view along line 3—3 of FIG. 1.

Referring to FIGS. 1 and 2, an entry mat 10 for placement before an entry door is shown. The entry mat 10 includes a plastic frame member 12, a liquid reservoir 14 with an open top, a plurality of adjacent parallel generally cylindrical brushes 16, 18, 20, 22, 24, 26, 28 (FIG. 3), wiping mat portions 30*a*, 30*b*, and a taut liquid absorbing fabric material 32, here made from terry cloth, mounted within the frame member 12 as shown. As shown in FIG. 2, various compartments here approximately 1.5 inches deep accommodate components of the mat 10. In particular, compartments 34*a* and 34*b* accept conventional wiping mat portions 30*a*, 30*b* that reside freely therein. Compartment 36 provides for the taut reception of the fabric material 32 which has a platform member 38 there beneath when in place. A stretcher 40 here in the form of a four-sided frame functions to retain the fabric material 32 in a taut configuration by friction fit around the base as well as within a groove 42 into which the wall 44 of the stretcher 40 enters and in which the border 46 of the fabric material 32 is also retained.

Figure 4:
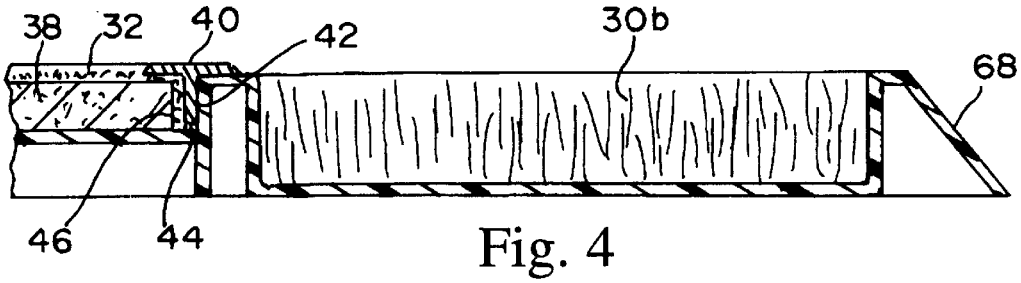
FIG. 4 is a cross section view along line 4—4 of FIG. 1.
Figure 5:
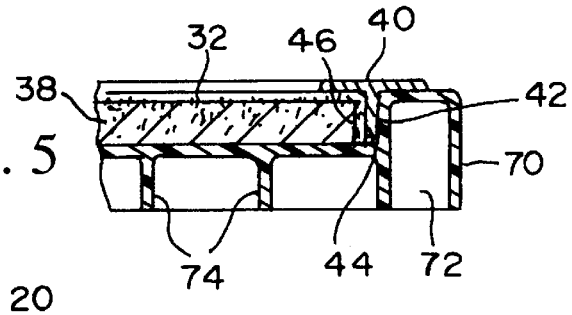
FIG. 5 is a cross section view along line 5—5 of FIG. 1.
Figure 6:
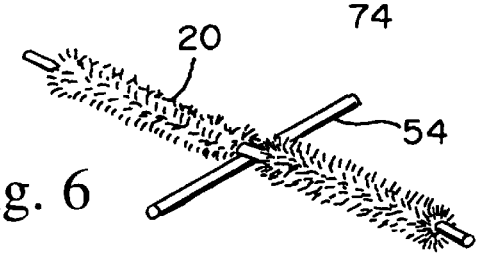
FIG. 6 is a perspective view of a single cylindrical cleaning brush in relation to a support therefor when in place above a liquid reservoir of the mat of FIGS. 1 and 2.

The liquid reservoir 14 has opposing side walls 48, 50 each having a series of apertures 52 within which the cylindrical brushes 16, 18, 20, 22, 24, 26, 28 are mounted. A support rod 54 extends beneath the brushes 16, 18, 20, 22, 24, 26, 28, and is held in place within opposing apertures 56, 58 as shown in FIGS. 3 and 6. While at least one of the brushes 16, 18, 20, 22, 24, 26, 28 must rotate, the three center brushes 20, 22, 24 of the preferred embodiment here shown rotate, while the two brushes 16, 18, 26, 28 on either side thereof are fixed. The reservoir 14 is provided with an aperture 60 with a plug 62 extending through the frame 12 for draining liquid. As is specifically shown in FIGS. 3, 4 and 5, the frame 12 has three outwardly sloping side walls 64, 66, 68 and one non-sloping side wall 70. This configuration permits placement of the non-sloping side wall 70 flush against entry way framing while preventing tripping of a person approaching the entry mat 10 from the front or side thereof. A hand grip cavity 72 is provided as shown in FIG. 5 beneath the non-sloping side wall 70 for carrying the entry mat 10 from place to place. Various structural ribs 74 as exemplified in FIGS. 3 and 5 are present in the plastic frame 12 to provide structural stability to the frame 12 as would be recognized in the art.

Efficient use of the entry mat 10 is accomplished when a user first wipes his or her shoe soles on the wiping mat portions 30*a*, 30*b* to attempt removal of larger debris. Thereafter, the user places one shoe sole at a time on the brushes 16, 18, 20, 22, 24, 26, 28 and moves the shoe longitudinally to cause rotation of the rotatable brushes 20, 22, 24. Because the brushes 16, 18, 20, 22, 24, 26, 28 are positioned such that downwardly directed bristles thereof are in liquid such as water within the reservoir 14, rotation of the brushes 20, 22, 24 results in the application of liquid to the shoe sole in addition to the abrasive action by the bristles to substantially wash the shoe sole. Upon completion of this washing, the wearer steps to the taut liquid absorbing fabric material 32 to dry the sole. Because. the fabric material 32 is tightly retained, sole drying can be effectively accomplished since the fabric material 32 does not move with the shoe, thus making such taut retention important in rendering utility to the entry mat 10. After washing and drying one shoe sole as described above, the sole of the other shoe is cleansed in the same way. Thereafter, the user comfortably enters the home, business, or other structure whose floor is being protected from unwanted particulate being introduced by shoe soles. The above described washing step results in the collection of these unwanted particles being infused into the liquid in the reservoir 14. When the liquid becomes increasingly dirty, the plug 62 is removed to permit the liquid to drain out. Thereafter, the plug 62 is replaced and fresh liquid is poured into the reservoir 14 through the bristles of the brushes 16, 18, 20, 22, 24, 26, 28. Likewise, when the fabric material 32 becomes soiled from shoe soles, the stretcher 40 is removed, a clean piece of material 32 is positioned, and the stretcher is replaced. Wiping mat portions 30*a*, 30*b* and brushes 16, 18, 20, 22, 24, 26, 28 are replaced as needed due to wear, weathering, and the like.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. An entry mat for placement before an entry door to permit cleaning of shoe soles prior to entry of a shoe wearer through the door, the entry mat comprising:

a) a liquid reservoir with an open top;

b) a plurality of adjacent parallel generally cylindrical brushes mounted such that certain bristles thereof extend outwardly from the open top of the liquid reservoir for engagement of a shoe bottom and certain bristles thereof extend inwardly into the reservoir, with at least one of said cylindrical brushes being rotatable with appropriate foot action thereto by a user;

c) a liquid absorbing fabric material releasably retained in a taut configuration by a stretcher;

d) a wiping mat; and e) a frame member having respective compartments within which the liquid reservoir, liquid absorbing fabric material and wiping mat are housed.

2. An entry mat as claimed in claim 1 wherein a plurality of the cylindrical brushes are rotatable.

3. An entry mat as claimed in claim 2 wherein the liquid absorbing fabric material is a cotton material.

4. An entry mat as claimed in claim 3 wherein the wiping mat is constructed of a fibrous material.

5. An entry mat as claimed in claim 4 wherein the wiping mat is divided into two portions, with each portion thereof disposed opposingly laterally from the liquid reservoir and liquid absorbing fabric material.

6. An entry mat as claimed in claim 5 wherein the liquid reservoir has leading therefrom a selectively openable aperture through which liquid within the reservoir can be released.

7. An entry mat as claimed in claim 6 wherein the frame member has three outwardly sloping side walls and one generally non-sloping side wall.

8. An entry mat as claimed in claim 1 wherein the liquid absorbing fabric material is a cotton material.

9. An entry mat as claimed in claim 1 wherein the wiping mat is constructed of a fibrous material.

10. An entry mat as claimed in claim 1 wherein the wiping mat is divided into two portions, with each portion thereof disposed opposingly laterally from the liquid reservoir and liquid absorbing fabric material.

11. An entry mat as claimed in claim 1 wherein the liquid reservoir has leading therefrom a selectively openable aperture through which liquid within the reservoir can be released.

12. An entry mat as claimed in claim 1 wherein the frame member has three outwardly sloping side walls and one generally non-sloping side wall.

* * * * *